US010414183B2

(12) United States Patent
Zeleny

(10) Patent No.: US 10,414,183 B2
(45) Date of Patent: Sep. 17, 2019

(54) FREE AXIS OR FREE-ROLLING PRINTER

(71) Applicant: Joseph L. Zeleny, Sacramento, CA (US)

(72) Inventor: Joseph L. Zeleny, Sacramento, CA (US)

( * ) Notice: Subject to any disclaimer, the term of this patent is extended or adjusted under 35 U.S.C. 154(b) by 0 days.

(21) Appl. No.: 15/689,243

(22) Filed: Aug. 29, 2017

(65) Prior Publication Data

US 2018/0056686 A1 Mar. 1, 2018

Related U.S. Application Data

(60) Provisional application No. 62/380,668, filed on Aug. 29, 2016.

(51) Int. Cl.

| | |
|---|---|
| ***B41J 29/393*** | (2006.01) |
| ***B41J 25/00*** | (2006.01) |
| ***B41J 29/02*** | (2006.01) |
| ***B41J 29/70*** | (2006.01) |
| ***B41J 29/13*** | (2006.01) |
| ***B41J 2/175*** | (2006.01) |
| ***B41J 3/36*** | (2006.01) |
| ***B41J 29/38*** | (2006.01) |
| *B41J 3/407* | (2006.01) |

(52) U.S. Cl.

CPC ..... *B41J 29/393* (2013.01); *B41J 2/175* (2013.01); *B41J 2/1752* (2013.01); *B41J 2/17546* (2013.01); *B41J 2/17553* (2013.01); *B41J 3/36* (2013.01); *B41J 25/006* (2013.01); *B41J 29/02* (2013.01); *B41J 29/023* (2013.01); *B41J 29/13* (2013.01); *B41J 29/38* (2013.01); *B41J 29/70* (2013.01); *B41J 3/407* (2013.01)

(58) Field of Classification Search

None

See application file for complete search history.

(56) References Cited

U.S. PATENT DOCUMENTS 5,619,237 A * 4/1997 Inoue ..... B41J 2/17503 347/86
2001/0037639 A1* 11/2001 Stahlecker ..... D01H 1/22 57/315
2002/0158955 A1* 10/2002 Hess ..... B41J 3/28 347/108

(Continued)

*Primary Examiner* — Erica S Lin

(74) *Attorney, Agent, or Firm* — Craig A. Simmermon

(57) ABSTRACT

Free axis or free-rolling printer is a self-propelled printer capable of printing on any stationary flat horizontal surface by moving itself around the stationary flat horizontal surface while ejecting the ink or colorants onto the stationary flat horizontal surface to create the clear image on the stationary flat horizontal surface. Free axis or free-rolling printer has at least one print media socket that is capable of accepting a plurality of interchangeable print media cartridges. Free axis or free-rolling printer has an X-axis tread system with a servomotor. Free axis or free-rolling printer has a retractable Y-axis tread system with a drive servomotor, a gantry servomotor, and a gantry assembly to lift and lower the Y-axis tread system. Free axis or free-rolling printer has a main circuit board with electrical continuity with a power source, the X-axis tread system servomotor, the Y-axis tread system drive servomotor, and the Y-axis gantry servomotor.

1 Claim, 12 Drawing Sheets

(56) References Cited

U.S. PATENT DOCUMENTS

| | | | | |
|---|---|---|---|---|
| 2009/0321151 | A1* | 12/2009 | Archambault ..... | B62D 49/0678<br>180/9.21 |
| 2010/0194013 | A1* | 8/2010 | Hall ..... | C02F 1/006<br>269/56 |
| 2010/0212437 | A1* | 8/2010 | O'Caoimh ..... | G01N 35/1011<br>73/864.11 |

* cited by examiner

FREE AXIS OR FREE-ROLLING PRINTER

BACKGROUND OF THE INVENTION

1. Field of the Invention

This invention pertains to a printer that ejects ink or colorants onto a surface to yield a clearly printed image on the surface. Specifically, this invention relates to a special printer that is self-propelled and capable of printing on any stationary flat horizontal surface by moving itself around the stationary flat horizontal surface while ejecting the ink or colorants onto the stationary flat horizontal surface to create the clear image on the stationary flat horizontal surface.

2. Description of Related Art

Most printers in the prior art are stationary which operate or print by moving the print surface through the printer, which remains stationary. There are some self-propelled printers in the prior art but none have the X-axis drive system and the retractable Y-axis drive system disclosed herein. Additionally, none of the self-propelled printers in the prior art have the interchangeable colorant cartridge system disclosed herewith which includes a special locking mechanism that firmly locks the interchangeable colorant cartridge within the bottom of the printer.

BRIEF SUMMARY OF THE INVENTION

It is an aspect of free axis or free-rolling printer to be self-propelled and capable of self-propelled movement along a flat horizontal plane or surface under its own power.

It is an aspect of free axis or free-rolling printer to print onto a stationary print surface that is a flat horizontal plane or surface made of any material.

It is an aspect of free axis or free-rolling printer to include a main circuit board or motherboard as well as a servomotor control circuit board.

It is an aspect of free axis or free-rolling printer to have a tread system that causes motion along an x-axis of the flat horizontal plane or surface It is an aspect of free axis or free-rolling printer to have a tread that causes motion along a y-axis of the flat horizontal plane or surface.

It is an aspect of x-axis tread system to include at least one track that is looped around a gearbox that is linked to a servomotor.

It is an aspect of y-axis tread system to include at least one track that is looped around a gearbox that is linked to a servomotor.

It is an aspect of y-axis tread system to be retractable and capable reversible contact with the flat horizontal plane or surface.

It is an aspect of free axis or free-rolling printer to be a color printer and a black and white printer.

It is an aspect of free axis or free-rolling printer to include a plurality of interchangeable ink or medium cartridges.

It is an aspect of free axis or free-rolling printer to accept, marry-to, receive therein, or reversibly attach to one or more interchangeable ink or medium cartridges.

It is an aspect of free axis or free-rolling printer to allow for the interchangeability of various different types of interchangeable ink or medium cartridges to allow for free axis or free-rolling printer to successfully print on any known type material or surface.

It is an aspect of each of the plurality of interchangeable ink or medium cartridges to contain four reservoirs where each reservoir is filled with an ink jet ink, garment based ink, solvent based ink, or any other known type of ink, paint, dye, or colorant.

It is an aspect of each of the plurality of interchangeable ink or medium cartridges to contain four print heads where each is capable of ejecting ink jet ink, garment based ink, solvent based ink, or any other known type of ink, paint, dye, or colorant in a precise and/or accurate fashion to yield a clearly imaged print out.

It is an aspect of each of the plurality of interchangeable ink or medium cartridges to contain a locking mechanism that holds and locks interchangeable ink or medium cartridge steady and motionless relative to the rest of the free axis or free-rolling printer when interchangeable ink or medium cartridge is properly attached to free axis or free-rolling printer.

It is an aspect of each of the plurality of interchangeable ink or medium cartridges to include an internal electronic chip or circuit board that identifies the type of colorant contained within the interchangeable ink or medium cartridge where internal electronic chip or circuit board is capable of communicating with the main circuit board or motherboard on the free axis or free-rolling printer.

It is an aspect of free axis or free-rolling printer to adjust its rate of motion along the flat horizontal plane or surface according to the specific type of print media or medium that is loaded into the free axis or free-rolling printer.

It is an aspect of free axis or free-rolling printer to adjust the flow rate of print media or medium being ejected from the interchangeable ink or medium cartridges according to the specific type of print media or medium that is loaded into the free axis or free-rolling printer.

BRIEF DESCRIPTION OF THE DRAWINGS

FIG. 11 also defines cross-sectional planes 12-12, 13-13, 14-14, 16-16, and 18-18.

DEFINITION LIST

Figure 1:
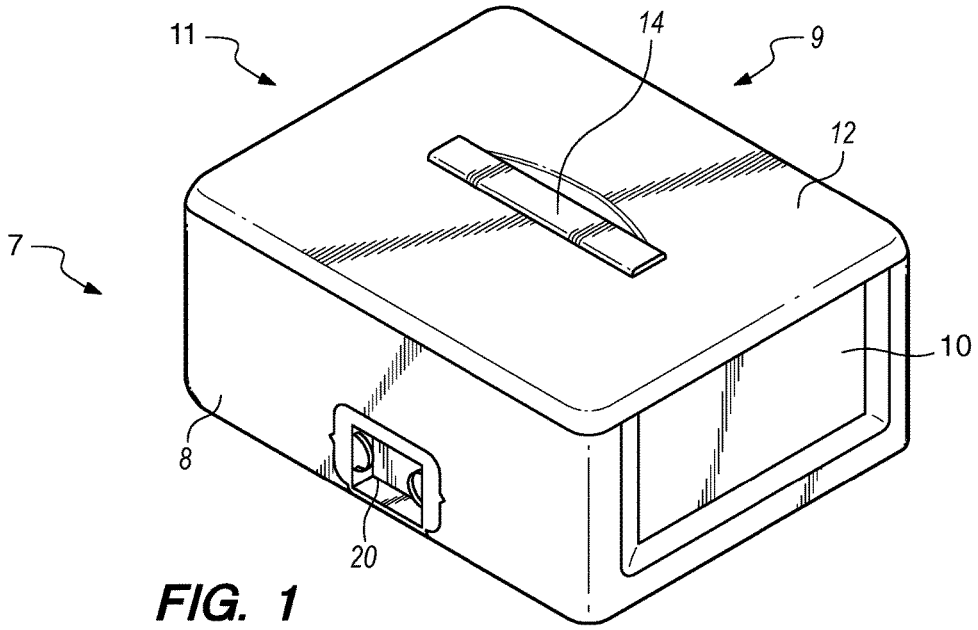
FIG. 1 is a top perspective view of free axis or free-rolling printer.
Figure 2:
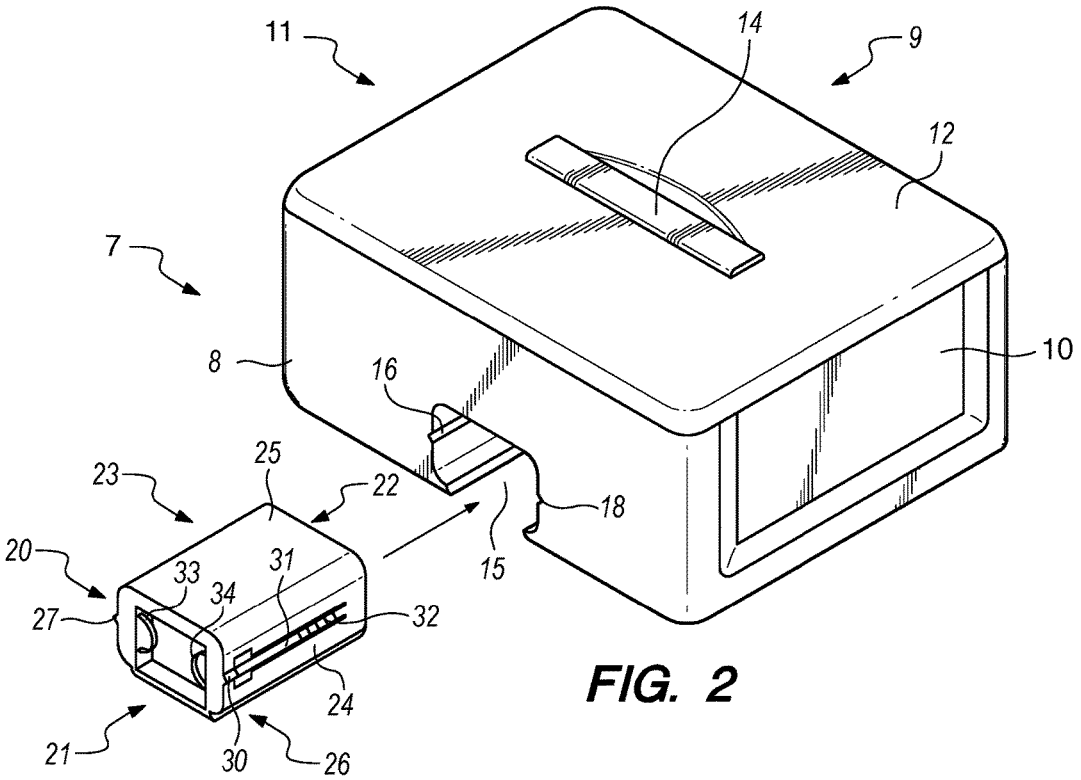
FIG. 2 is a top perspective view of free axis or free-rolling printer depicting how a print media cartridge is installed into free axis or free-rolling printer.
Figure 3:
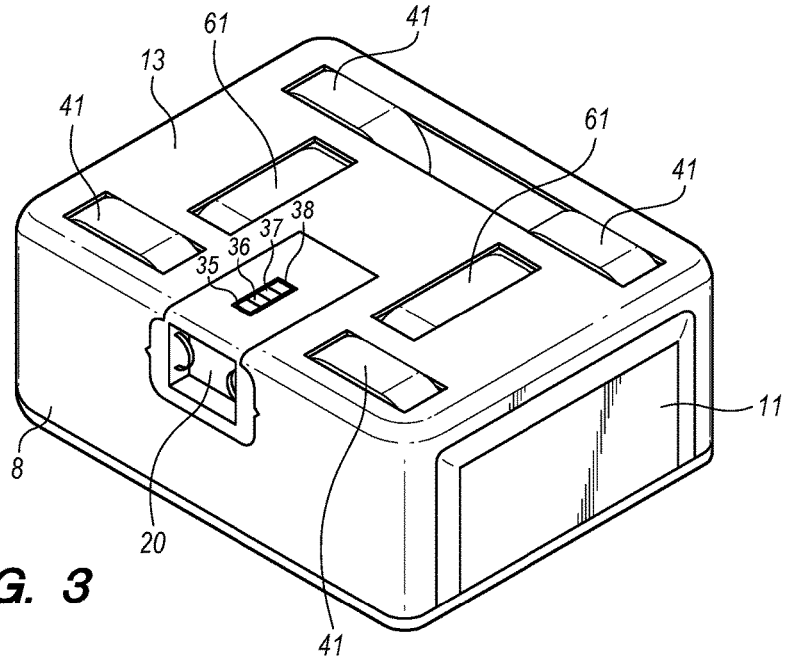
FIG. 3 is a bottom perspective view of free axis or free-rolling printer.
Figure 4:
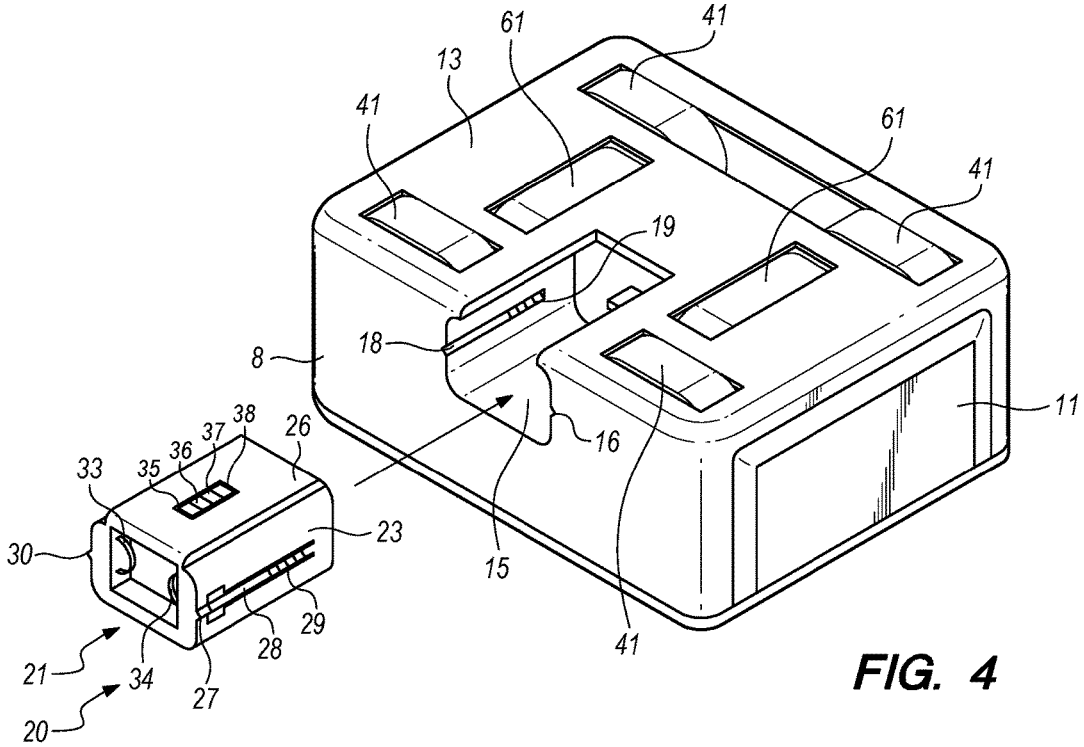
FIG. 4 is a bottom perspective view of free axis or free-rolling printer depicting how a print media cartridge is installed into free axis or free-rolling printer.
Figure 5:
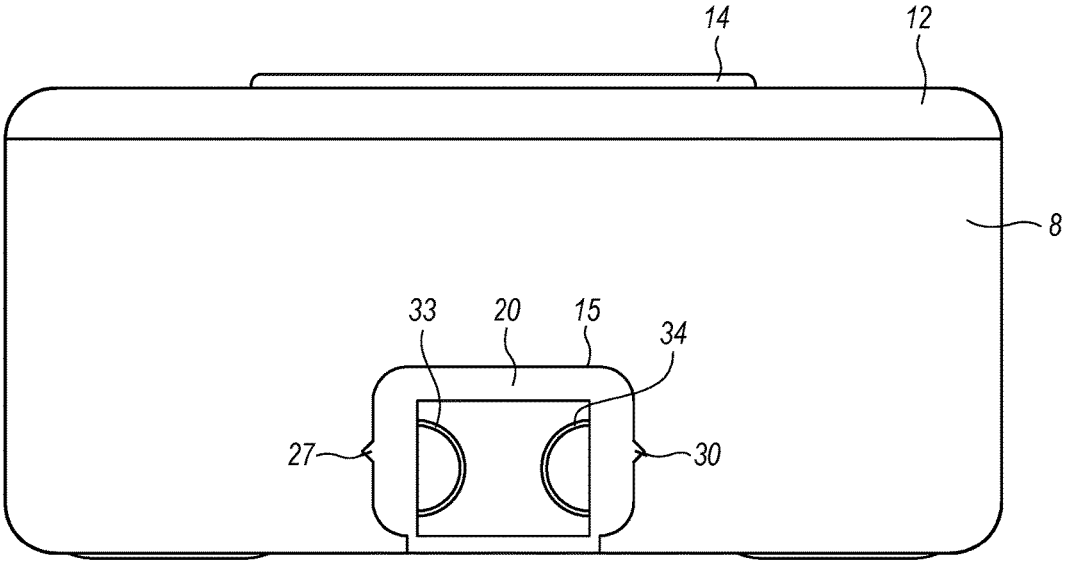
FIG. 5 is a front elevation view of free axis or free-rolling printer.
Figure 6:
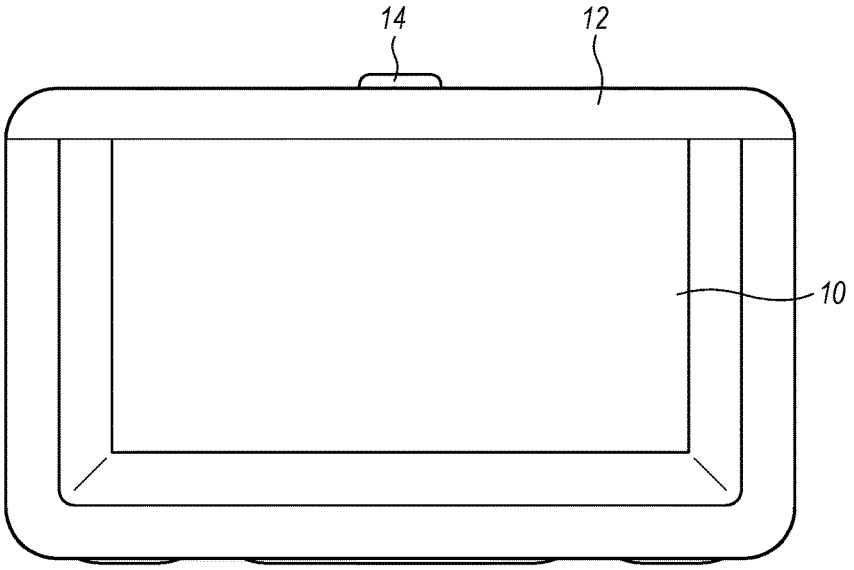
FIG. 6 is a side elevation view of free axis or free-rolling printer. Note that left side elevation view and right side elevation view are identical.
Figure 7:
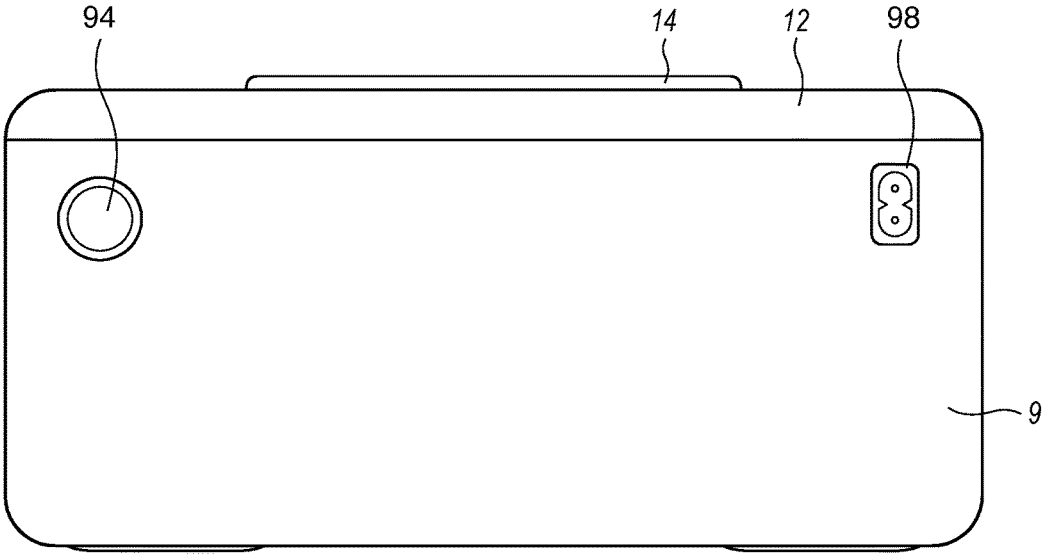
FIG. 7 is a rear elevation view of free axis or free-rolling printer.
Figure 8:
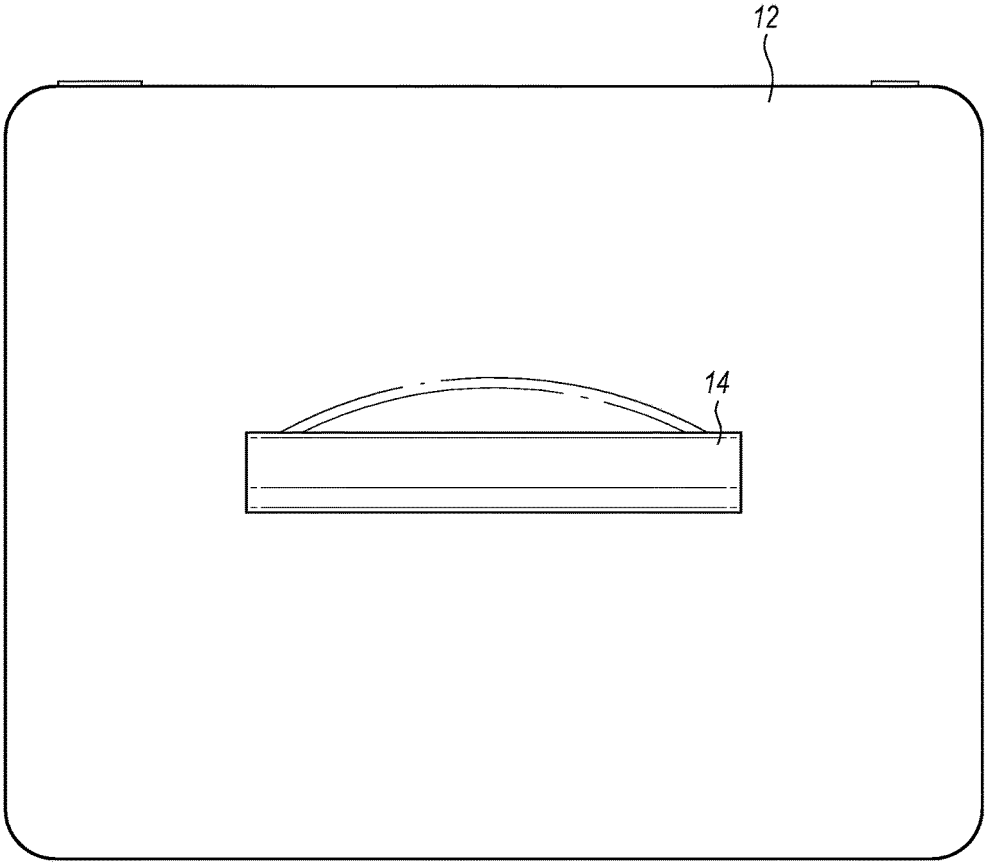
FIG. 8 is a top plan view of free axis or free-rolling printer.
Figure 9:
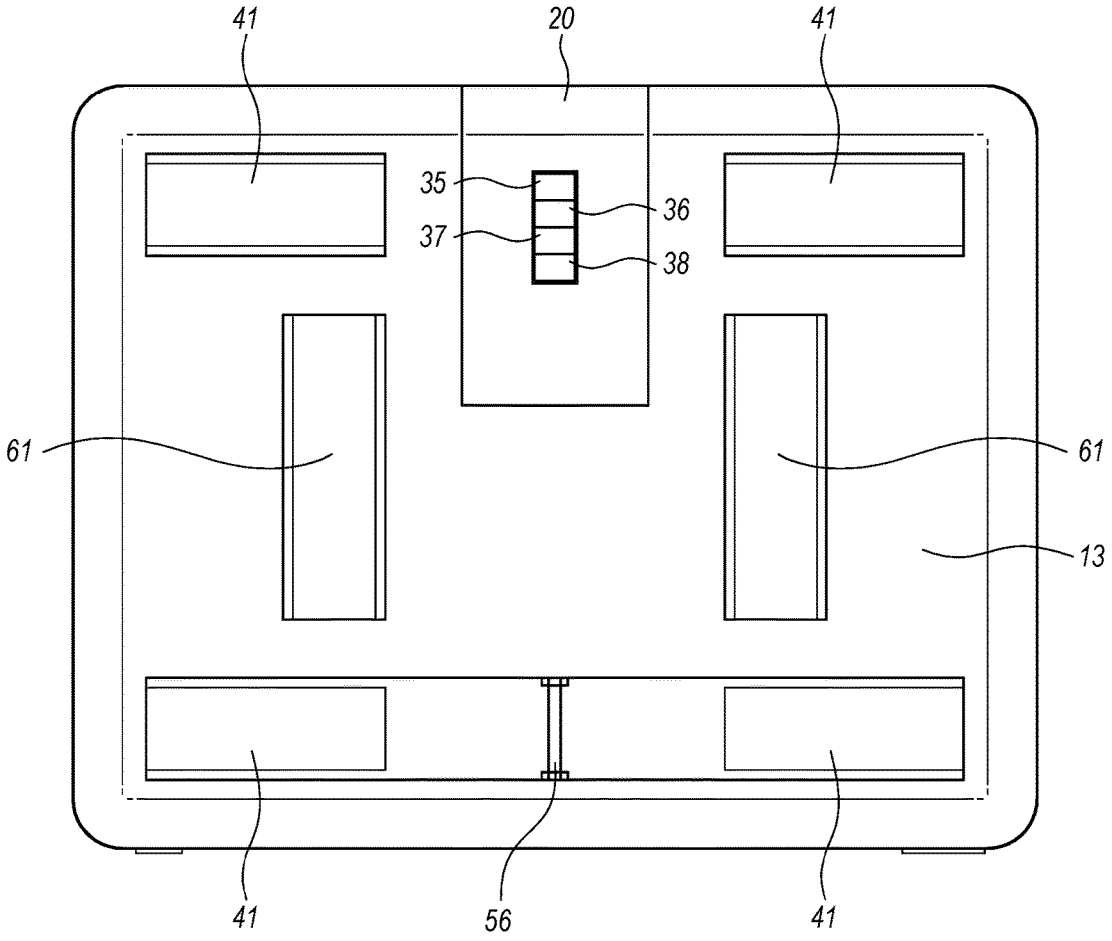
FIG. 9 is a bottom plan view of free axis or free-rolling printer.
Figure 10:
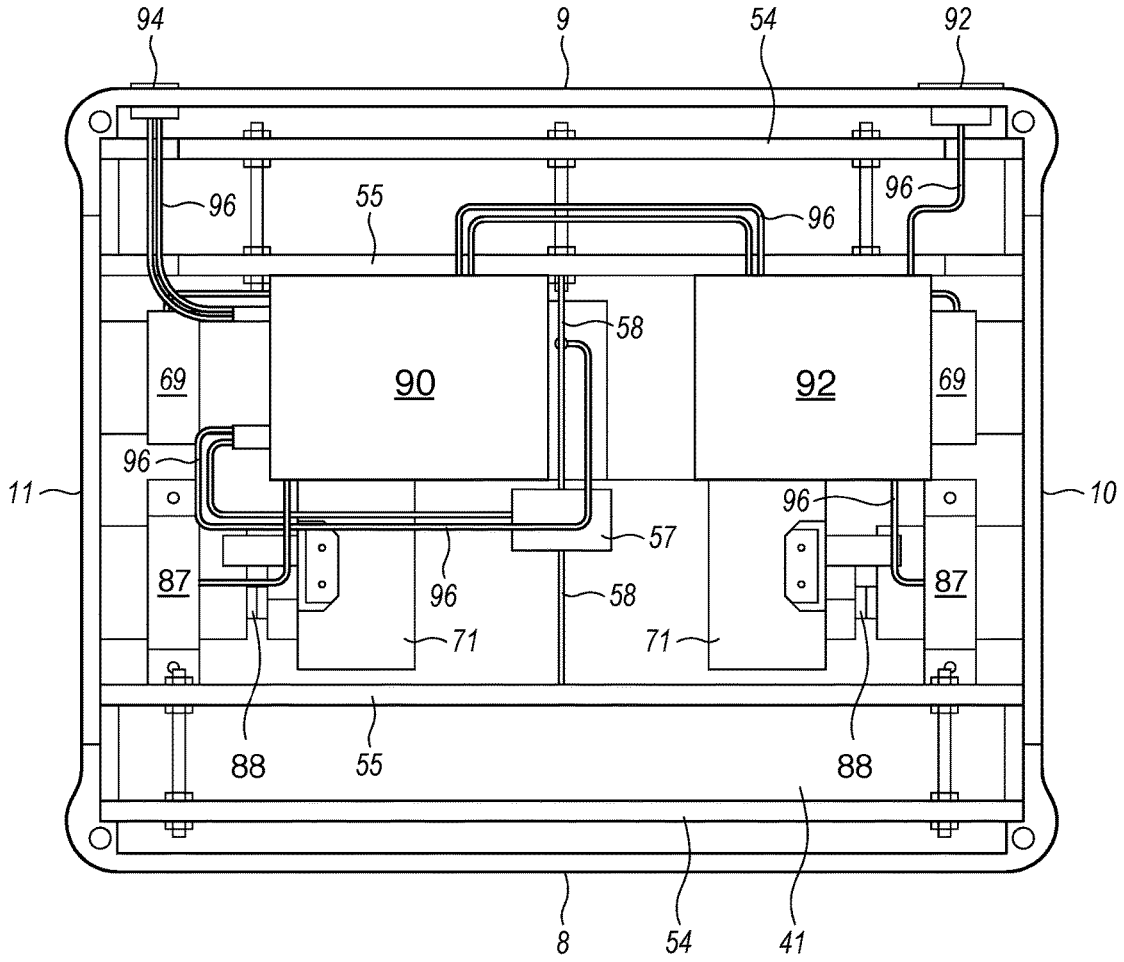
FIG. 10 is a top plan view of free axis or free-rolling printer with printer housing top side removed.
Figure 11:
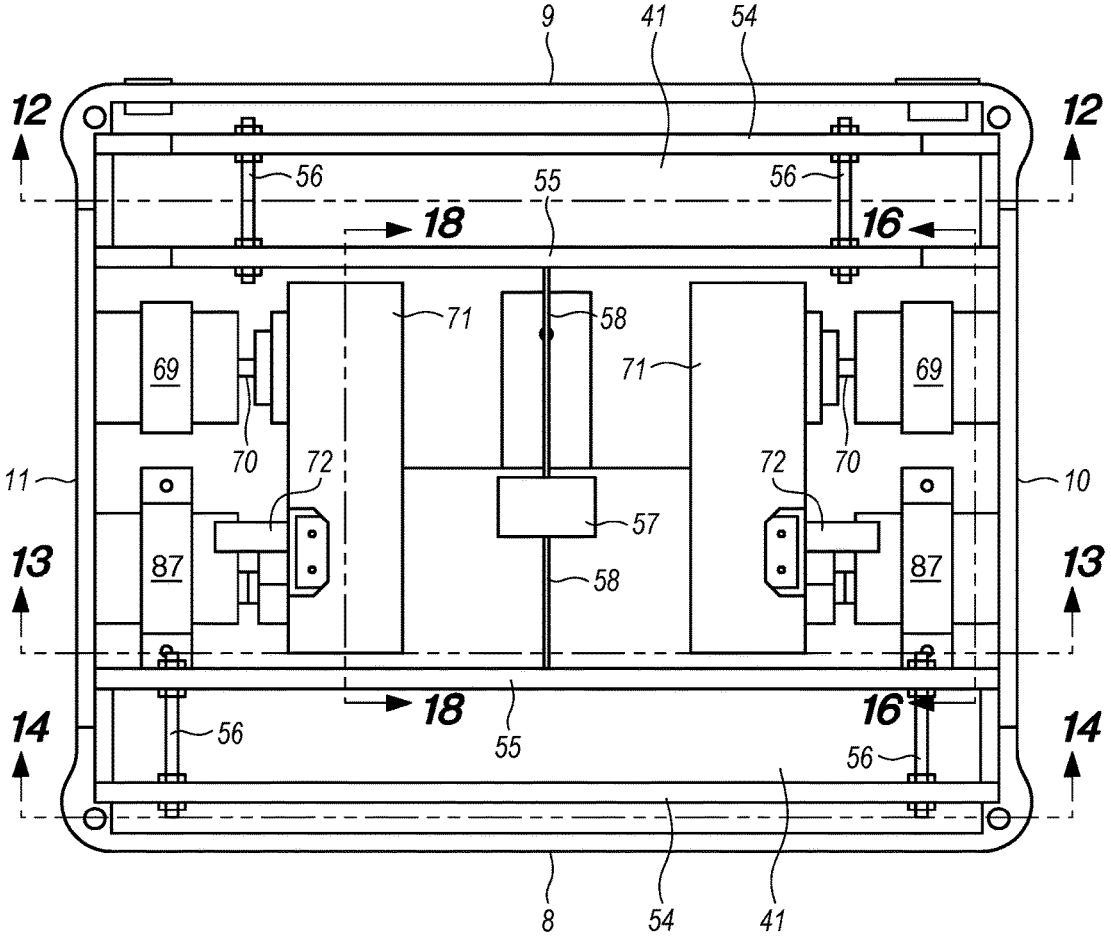
FIG. 11 is a top plan view of free axis or free-rolling printer with: printer housing top side, main circuit board, servomotor control circuit board, and electrical wiring removed.
Figure 12:
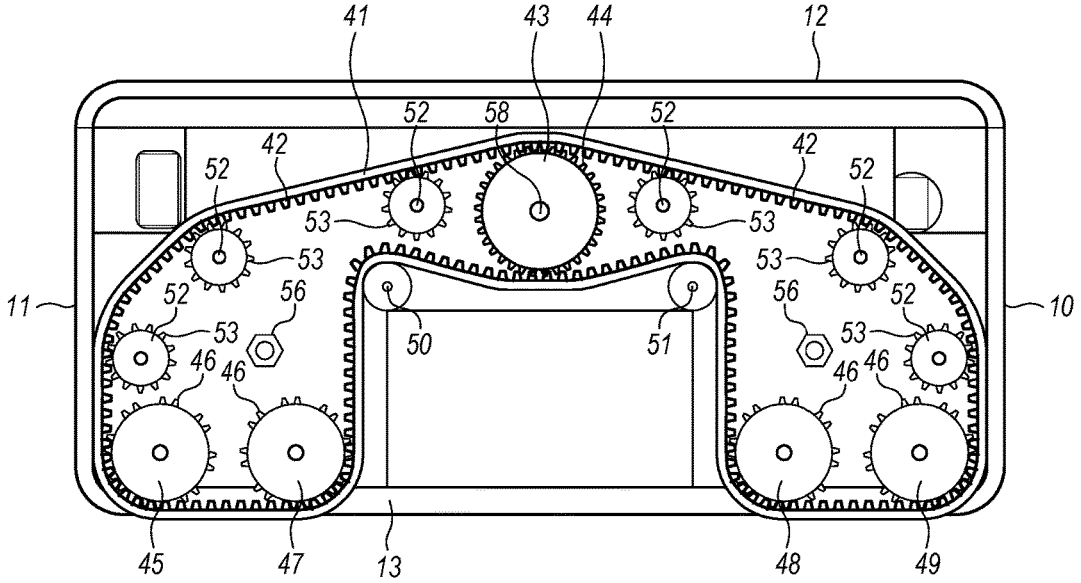
FIG. 12 is a cross-sectional view taken from lines 12-12.
Figure 13:
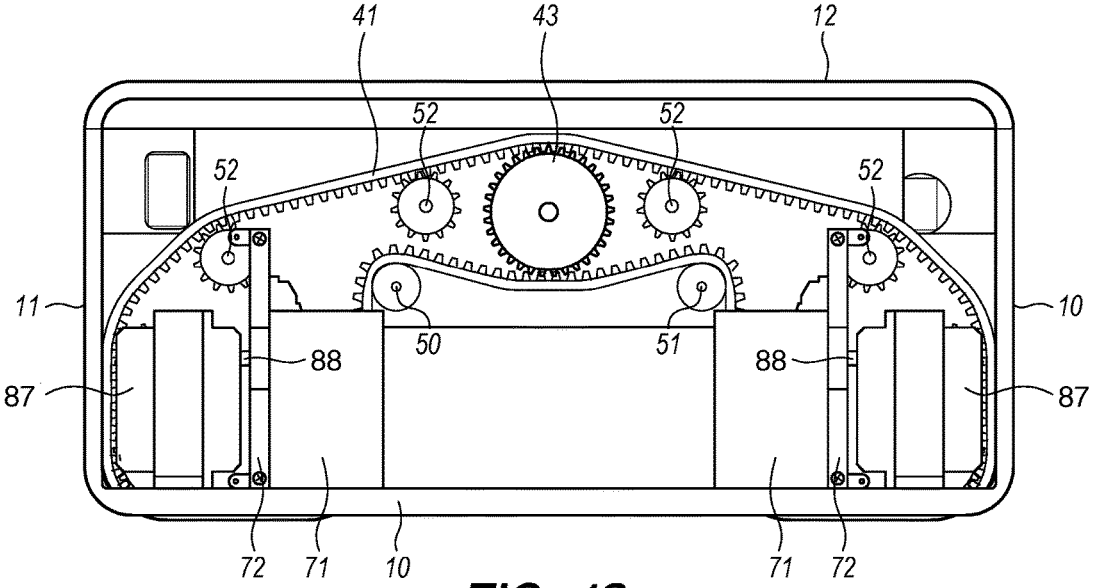
FIG. 13 is a cross-sectional view taken from lines 13-13.
Figure 14:
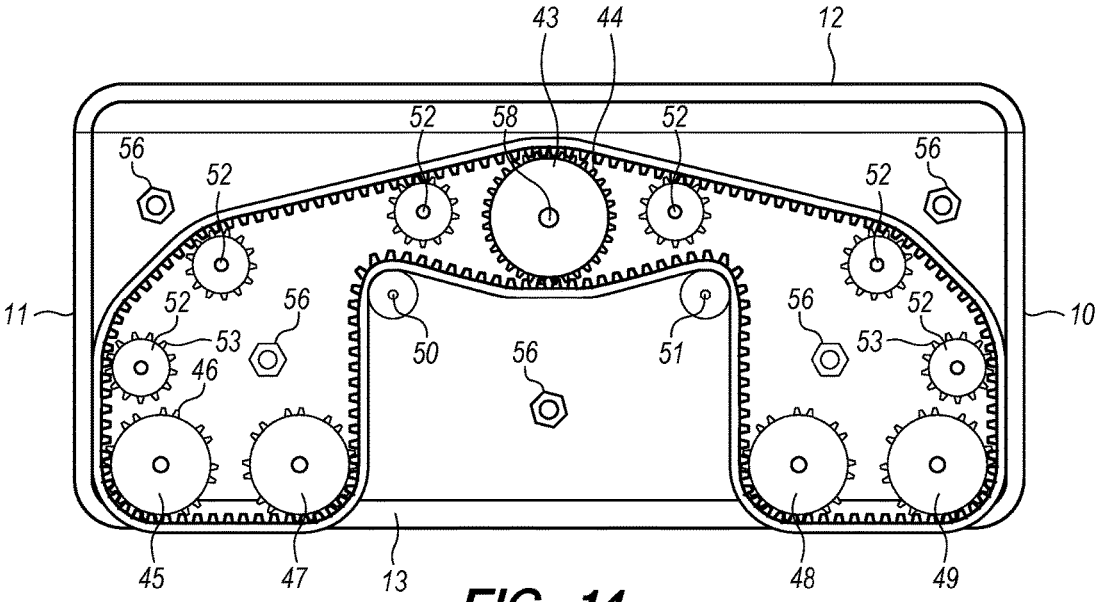
FIG. 14 is a cross-sectional view taken from lines 14-14.
Figure 15:
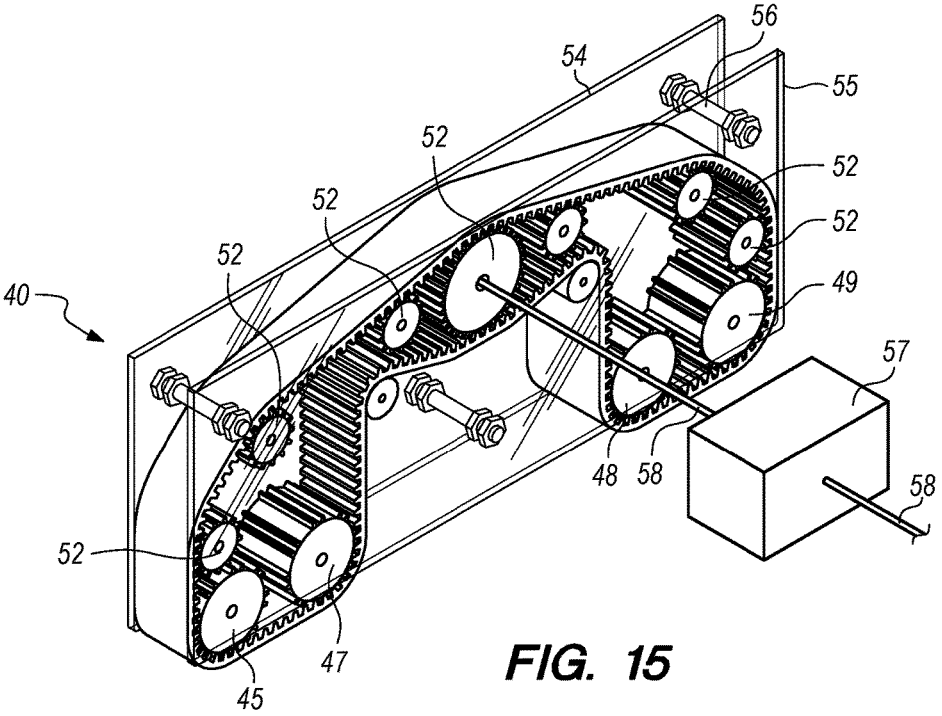
FIG. 15 is a perspective cutaway view of X-axis tread system.

| Term | Definition |
|---|---|
| 5 | Free Axis or Free-Rolling Printer |
| 7 | Printer Housing |
| 8 | Printer Housing Front Side |
| 9 | Printer Housing Rear Side |
| 10 | Printer Housing Left Side |
| 11 | Printer Housing Right Side |
| 12 | Printer Housing Top Side |
| 13 | Printer Housing Bottom Side |
| 14 | Handle |
| 15 | Print Media Cartridge Socket |
| 16 | Left Alignment Groove |
| 17 | Left Alignment Groove Locking Teeth |
| 18 | Right Alignment Groove |
| 19 | Right Alignment Groove Locking Teeth |
| 20 | Print Media Cartridge |
| 21 | Cartridge Housing Front Side |
| 22 | Cartridge Housing Rear Side |
| 23 | Cartridge Housing Left Side |
| 24 | Cartridge Housing Right Side |
| 25 | Cartridge Housing Top Side |
| 26 | Cartridge Housing Bottom Side |
| 27 | Left Alignment Fin |
| 28 | Left Alignment Tongue |
| 29 | Left Alignment Tongue Locking Teeth |
| 30 | Right Alignment Fin |
| 31 | Right Alignment Tongue |
| 32 | Right Alignment Tongue Locking Teeth |
| 33 | Left Pinch Tab |
| 34 | Right Pinch Tab |
| 35 | Print Head One |
| 36 | Print Head Two |
| 37 | Print Head Three |
| 38 | Print Head Four |
| 39 | Void Area |
| 40 | X-Axis Tread System |
| 41 | X-Axis Continuous Track or Tread |
| 42 | X-Axis Track Ridge |
| 43 | X-Axis Drive Gear |
| 44 | X-Axis Drive Gear Tooth or Ridge |
| 45 | First X-Axis Foot Gear |
| 46 | X-Axis Foot Gear Tooth or Ridge |
| 47 | Second X-Axis Foot Gear |
| 48 | Third X-Axis Foot Gear |
| 49 | Fourth X-Axis Foot Gear |
| 50 | First X-Axis Roller |
| 51 | Second X-Axis Roller |
| 52 | X-Axis Upper Alignment Gear |
| 53 | Upper Alignment Gear Tooth or Ridge |
| 54 | X-Axis Tread System Outside Panel |
| 55 | X-Axis Tread System Inside Panel |
| 56 | X-Axis Tread System Spacer |
| 57 | X-Axis Servomotor |
| 58 | X-Axis Drive Axle |
| 60 | Y-Axis Tread System |
| 61 | Y-Axis Continuous Track or Tread |
| 62 | Y-Axis Track Ridge |
| 63 | Y-Axis Drive Gear |
| 64 | Y-Axis Drive Gear Tooth or Ridge |

-continued

| Term | Definition |
|---|---|
| 65 | Y-Axis Foot Gear |
| 66 | Y-Axis Foot Gear Tooth or Ridge |
| 67 | Y-Axis Top Gear |
| 68 | Y-Axis Top Gear Tooth or Ridge |
| 69 | Y-Axis Servomotor |
| 70 | Y-Axis Drive Axle |
| 71 | Y-Axis Tread System Housing |
| 72 | Gantry Assembly |
| 73 | Gantry Rack |
| 74 | Rack Housing |
| 75 | Gantry Pinion or Gear |
| 76 | Gantry Bracket |
| 78 | Rack Housing Top Side |
| 79 | Rack Housing Bottom Side |
| 80 | Rack Housing Front Side |
| 81 | Rack Housing Rear Side |
| 82 | Rack Housing Inner Side |
| 83 | Rack Housing Outer Side |
| 84 | Rack Pin |
| 85 | Rack Pin Slot |
| 86 | Pinion or Gear Window |
| 87 | Gantry Servomotor |
| 88 | Gantry Servomotor Axle |
| 90 | Main Circuit Board or Motherboard |
| 92 | Servomotor Control Circuit Board |
| 94 | On/Off Switch |
| 96 | Electrical Wiring |
| 98 | Power Connector |
| 100 | Printing Surface |

DETAILED DESCRIPTION OF THE INVENTION

Free axis or free-rolling printer 5 comprises a printer housing 7. Printer housing 7 is a rigid hollow rectangular cuboid member or box-shaped member that houses or encases all electrical and mechanical components of free axis or free-rolling printer 5, with the exception of the print media cartridges 20, which are removeably attachable to printer housing 7. Printer housing 7 comprises: a printer housing front side 8, a printer housing rear side 9, a printer housing left side 10, a printer housing right side 11, a printer housing top side 12, and a printer housing bottom side 13. Printer housing front side 8, printer housing rear side 9, printer housing left side 10, printer housing right side 11, printer housing top side 12, and printer housing bottom side 13 each are a rigid rectangular planar member with a longitudinal axis, a lateral axis, an inside surface, an outside surface, and four edges. Printer housing front side 8, printer housing rear side 9, printer housing left side 10, printer housing right side 11, printer housing top side 12, and printer housing bottom side 13 are rigidly connected to each other at their edges to form the rigid hollow rectangular cuboid member or hollow box-shaped member as depicted. The edges and/or corners of the rectangular cuboid member or hollow box-shaped member may be rounded as depicted.

Printer housing bottom side 13 further comprises at least two X-axis tread clearance windows or void areas. At least two X-axis tread clearance windows or void areas function to provide clearance space for an X-axis tread system 40 and an X-axis continuous track or tread 41 to extend downward through at least two X-axis tread clearance windows or void areas in order to make contact with the printing surface 100 as described below. Printer housing bottom side 13 further comprises at least one Y-axis tread clearance window or void area. At least one Y-axis tread clearance window or void area to allow functions to provide clearance space for a Y-axis tread system 60 and a Y-axis continuous track or tread 61 to extend downward through at least one Y-axis tread clearance window or void area to allow for reversible contact with the printing surface 100 as described below.

Alternately, printer housing top side 12 may be removeably attachable to the rest of the rigid hollow rectangular cuboid member or hollow box-shaped member to yield a removable lid to the rigid hollow rectangular cuboid member or hollow box-shaped member. Printer housing top side 12 may further comprises a handle 14 on its outside surface. Removable attachment may be accomplished by any know means such as by press fit, slip fit, latch or latches, fasteners, magnets, pins, or any other known means. Handle 14 is a handle member to allow for easier carrying of the free axis or free-rolling printer 5 and/or easier removal of printer housing top side 12 from the rigid hollow rectangular cuboid member or hollow box-shaped member. Handle 14 may be any known type of handle designed or sized to fit the human hand.

Printer housing 7 further comprises at least one print media cartridge socket 15. Each print media cartridge socket 15 functions to accept therein or reversibly attach therein a print media cartridge 20, which is described below. Each print media cartridge socket 15 is a specially shaped slot or void in printer housing bottom side 13. In best mode, the specially shaped slot or void of at least one print media cartridge socket 15 breaks out of printer housing front side 8 as depicted. Each print media cartridge socket 15 comprises: a left wall, a right wall, a rear wall, a top wall, an open bottom, and an open front, as depicted, which are each a rigid rectangular planar member with a longitudinal axis, a lateral axis, an inside surface, an outside surface, and four edges. Each print media cartridge socket 15 is sized and shaped to make a slip fit with the exterior of a print media cartridge 20.

The left wall of print media cartridge socket 15 comprises a left alignment groove 16. Left alignment groove 16 is an elongated horizontal groove or recess on the outside surface of left wall of print media cartridge socket 15, running parallel with the longitudinal axis of the left wall of print media cartridge socket 15 as depicted. Left alignment groove 16 has a length, a width, a depth, a distal end, and a proximal end. The length, width, and depth of left alignment groove 16 are sized to make a slip fit with the length, width, and height respectively of a left alignment tongue 28 on print media cartridge 20 described below. The distal end of left alignment groove 16 is located toward the inside of the print media cartridge socket 15. The proximal end of left alignment groove 16 is located toward the outside of the print media cartridge socket 15. The distal end of left alignment groove 16 comprises a plurality of left alignment groove locking teeth 17. Each left alignment grove locking tooth 17 is a pyramid-shaped or triangular-shaped tooth that has been carved, machined, molded, cast, or otherwise added into left alignment groove 16. Left alignment grove locking teeth 17 are sized, spaced, and shaped to make a slip fit with left alignment tongue locking teeth 29 on print media cartridge 20. Any particular shaped teeth positioned or located at any angle may be used. Left alignment grove locking teeth 17 function to locate and align print media cartridge 20 properly within free axis or free rolling printer 5 during insertion or installation of print media cartridge 20 into print media cartridge socket 15. Left alignment grove locking teeth 17 further function to lock onto left alignment tongue locking teeth 29 on print media cartridge 20 when the print media cartridge 20 is fully inserted and installed within free axis or free-rolling printer 5.

The right wall of print media cartridge socket 15 comprises a right alignment groove 18. Right alignment groove 18 is an elongated horizontal groove or recess on the outside surface of right wall of print media cartridge socket 15, running parallel with the longitudinal axis of the right wall of print media cartridge socket 15 as depicted. Right alignment groove 18 has a length, a width, a depth, a distal end, and a proximal end. The length, width, and depth of right alignment groove 18 are sized to make a slip fit with the length, width, and height respectively of a right alignment tongue 31 on print media cartridge 20 described below. The distal end of right alignment groove 18 is located toward the inside of the print media cartridge socket 15. The proximal end of right alignment groove 18 is located toward the outside of the print media cartridge socket 15. The distal end of right alignment groove 18 comprises a plurality of right alignment groove locking teeth 19. Each right alignment grove locking tooth 19 is a pyramid-shaped or triangular-shaped tooth that has been carved, machined, molded, cast, or otherwise added into right alignment groove 18. Right alignment grove locking teeth 19 are sized, spaced, and shaped to make a slip fit with right alignment tongue locking teeth 32 on print media cartridge 20. Any particular shaped teeth positioned or located at any angle may be used. Right alignment grove locking teeth 19 function to locate and align print media cartridge 20 properly within free axis or free rolling printer 5 during insertion or installation of print media cartridge 20 into print media cartridge socket 15. Right alignment grove locking teeth 19 further function to lock onto right alignment tongue locking teeth 32 on print media cartridge 20 when the print media cartridge 20 is fully inserted and installed within free axis or free-rolling printer 5.

Left and right alignment grove locking teeth 17,19 function to lock print media cartridge 20 firmly within free axis or free rolling printer 5 to hold print media cartridge 20 steady and without motion or vibration within free axis or free rolling printer 5 during operation of free axis or free rolling printer 5. The operation of free axis or free rolling printer 5 involves substantial movement of free axis or free rolling printer 5. Very typically, printer errors occur or blurred images are produced when a print media cartridge 20 moves relative to the rest of the free axis or free rolling printer 5 during the printing process and motion of free axis or free rolling printer 5. Therefore, it is very important for all print media cartridges 20 installed within free axis or free rolling printer 5 to remain motionless and free from vibration with respect to the rest of the free axis or free rolling printer 5.

The rear wall of print media cartridge socket 15 further comprises an electrical connector. This print media cartridge socket electrical connector functions to provide electrical continuity or an electrical connection between a print media cartridge 20 and a main circuit board or motherboard 150 located within the printer housing 7 of free axis or free-rolling printer 5, as discussed below. Print media cartridge socket electrical connector may be any known type of electrical connector such as a parallel or serial connector such as a USB connector.

Printer housing 7 may further comprises a second print media cartridge socket 15. In best mode, second print media cartridge socket 15 breaks out of printer housing rear side 9. Second print media cartridge socket 15 contains the same elements as the first print media cartridge socket 15 described above. With a second print media cartridge socket 15, free axis or free-rolling printer 5 may include and house two different types of print media cartridges 20 that hold two different types of liquid print media or ink in order to allow for printing onto two totally different surfaces such as one set of liquid print media or ink for printing onto fabric or clothing along with another set of liquid print media or ink for printing onto paper or sign board.

Free axis or free-rolling printer 5 further comprises at least one print media cartridge 20. Each print media cartridge 20 is a rigid hollow rectangular cuboid member or box-shaped member as depicted. Print media cartridge 20 comprises: a cartridge housing front side 21, a cartridge housing rear side 22, a cartridge housing left side 23, a cartridge housing right side 24, a cartridge housing top side 25, and a cartridge housing bottom side 26. Cartridge housing front side 21, a cartridge housing rear side 22, a cartridge housing left side 23, a cartridge housing right side 24, a cartridge housing top side 25, and a cartridge housing bottom side 26, each are a rigid rectangular planar member with a longitudinal axis, a lateral axis, an inside surface, an outside surface, and four edges. Cartridge housing front side 21, a cartridge housing rear side 22, a cartridge housing left side 23, a cartridge housing right side 24, a cartridge housing top side 25, and a cartridge housing bottom side 26 are rigidly connected to each other to form the rigid hollow rectangular cuboid member or hollow box-shaped member as depicted. The edges and/or corners of the rectangular cuboid member or hollow box-shaped member may be rounded as depicted.

Each print media cartridge 20 contains at least four print medium reservoirs, namely, print medium reservoir one, print medium reservoir two, print medium reservoir three, and print medium reservoir four. Each print medium reservoir is a tank or container that is capable of holding a volume of liquid print media or ink including ink jet ink, garment based ink, solvent based ink, or any other known type of liquid ink, liquid paint, liquid dye, or liquid colorant. Typically, each print medium reservoir holds a certain color liquid print media or ink, namely cyan, magenta, yellow, and black.

Each print media cartridge 20 also contains at least four print heads, namely, print head one 35, print head two 36, print head three 37, and print head four 38. Print head one 35 is plumbed to or connected to print medium reservoir one. Print head two 36 is plumbed to or connected to print medium reservoir two. Print head three 37 is plumbed to or connected to print medium reservoir three. Print head four 38 is plumbed to or connected to print medium reservoir four. Each print head 35,36,37,38 can be any known type of print head that is capable printing on a flat surface. Each print head 35,36,37,38 could be a thermal print head or piezoelectric print head. Each print head 35,36,37,38 is capable of ejecting ink jet ink, garment based ink, solvent based ink, or any other known type of ink, paint, dye, or colorant in a precise and/or accurate fashion in order to yield a clearly imaged print out.

Each print media cartridge 20 further comprises an electronic chip or circuit board. Print media cartridge electronic chip or circuit board may be any known type of electronic chip, circuit board, or integrated circuit. Print media cartridge electronic chip or circuit board has electrical continuity with each print head 35,36,37,38 or is otherwise connected by electrical wiring 96 to each print head 35,36,37,38. Each print media cartridge 20 further comprises an electrical connector located on the rear side 22 of print media cartridge 20. Print media cartridge electrical connector functions to provide electrical continuity or an electrical connection between print media cartridge electronic chip or circuit board and a main circuit board or motherboard 150 located within the printer housing 7 of free axis or free-rolling printer 5. Print media cartridge electrical connector on print media cartridge 20 mates with, pairs with, or otherwise reversibly connects with print media cartridge socket electrical connector on print media cartridge socket 15 when print media cartridge is installed within print media cartridge socket 15. Print media cartridge electrical connector may be any known type of electrical connector such as a parallel or serial connector such as a USB connector. Print media cartridge electrical connector has electric continuity with or is otherwise connected by electrical wiring 96 to print media cartridge electronic chip or circuit board.

Cartridge housing left side 23 further comprises a left alignment fin 27. Left alignment fin 27 is an oblong protrusion jutting perpendicularly outward from the outside surface of cartridge housing left side 23 as depicted. The longitudinal axis of the oblong protrusion runs parallel with the longitudinal axis of cartridge housing left side 23. Left alignment fin 27 has a length, a width, and a height that are each sized to make a slip-fit with the length, width, and depth respectively of left alignment groove 16. Length of left alignment fin 27 is about 0.1-1.0 inches. Width of left alignment fin 27 is about 0.01-0.5 inches. Height of left alignment fin 27 is about 0.01-0.8 inches. Left alignment fin 27 slides into left alignment groove 16 on print media cartridge socket 15 as the print media cartridge 20 is inserted within the print media cartridge socket 15. Left alignment fin 27 functions to locate and align print media cartridge 20 properly within print media cartridge socket 15 as print media cartridge 20 is inserted and installed into print media cartridge socket 15.

Cartridge housing left side 23 further comprises a left alignment tongue 28. Left alignment tongue 28 is an elongated horizontal ridge or protrusion jutting perpendicularly outward from the outside surface of cartridge housing left side 23 as depicted. The longitudinal axis of the elongated horizontal ridge or protrusion runs parallel with the longitudinal axis of cartridge housing left side 23. Left alignment tongue 28 is has a length, a width, a height, a distal end, and a proximal end. The length, width, and height of left alignment tongue 28 are sized to make a slip fit with the length, width, and depth respectively of left alignment groove 16 on print media cartridge socket 15. The distal end of left alignment tongue 28 is located toward the rear side 22 of the print media cartridge 20. The proximal end of left alignment tongue 28 is located toward the front side 21 of the print media cartridge 20.

The distal end of left alignment tongue 28 further comprises a plurality of left alignment tongue locking teeth 29. Each left alignment tongue locking tooth 29 is a pyramid-shaped or triangular-shaped void that has been carved, machined, molded, cast, or otherwise removed from left alignment tongue 28. Left alignment tongue locking teeth 29 are sized and shaped to make a slip fit with left alignment groove locking teeth 17 on print media cartridge socket 15. Any particular shaped void positioned or located at any angle may be used. Left alignment tongue locking teeth 29 function to locate print media cartridge 20 properly within free axis or free rolling printer 5 during installation within free axis or free-rolling printer 5. Left alignment tongue locking teeth 29 are the first portions of print media cartridge 20 to enter left alignment groove 16 during insertion or installation of print media cartridge 20 into print media cartridge socket 15. Left alignment tongue locking teeth 29 also function to lock onto left alignment groove locking teeth 17 on print media cartridge socket 15 when the print media cartridge 20 is fully inserted and installed within free axis or free-rolling printer 5. As stated, it is very important for the all print media cartridges 20 installed within free axis or free rolling printer 5 to remain motionless and free from vibration with respect to the rest of the free axis or free rolling printer 5.

There is a void area 39 around three sides of left alignment tongue 28. There is a void area 39 above left alignment tongue 28, below left alignment tongue 28, and around the proximal end of left alignment tongue 28 as depicted. These void areas 39 allow left alignment tongue 28 to slightly pivot around the distal end of left alignment tongue 28, which is the only end of left alignment tongue 28 that is attached to cartridge housing left side 23. In this way the entire left alignment tongue 28 becomes a hinge so to speak that can be pivoted inward, pressed inward, or flexed inward when pressed. When released, left alignment tongue 28 springs back outward or returns to its original position.

Cartridge housing front side 21 further comprises a window or void area to allow for access to a left pinch tab 33 as depicted. Left pinch tab 33 is a rigid loop, ring, cup, or depression that functions to provide an easy gripping point or grab point for a human finger or thumb. Left pinch tab 33 is rigidly connected to the proximal end of left alignment tongue 28. Left pinch tab 33 is accessible to the operator through the window or void area in cartridge housing front side 21. Left pinch tab 33 functions to allow the user to place their finger or thumb therein and squeeze or pull left alignment tongue 28 inward to cause the entire left alignment tongue 28 to pivot inward about its distal end which unlocks the print media cartridge 20 and allows for removal and/or insertion of print media cartridge 20. The user releases their thumb or finger from left pinch tab 33 to cause the entire left alignment tongue 28 to spring back or pivot back about its distal end to return to its original position in order to lock the print media cartridge 20.

Cartridge housing right side 24 further comprises a right alignment fin 30. Right alignment fin 30 is an oblong protrusion jutting perpendicularly outward from the outside surface of cartridge housing right side 24 as depicted. The longitudinal axis of the oblong protrusion runs parallel with the longitudinal axis of cartridge housing right side 24. Right alignment fin 30 has a length, a width, and a height that are each sized to make a slip-fit with the length, width, and depth respectively of right alignment groove 18. Length of right alignment fin 30 is about 0.1-1.0 inches. Width of right alignment fin 30 is about 0.01-0.5 inches. Height of right alignment fin 30 is about 0.01-0.8 inches. Right alignment fin 30 slides into right alignment groove 18 on print media cartridge socket 15 as the print media cartridge 20 is inserted within the print media cartridge socket 15. Right alignment fin 30 functions to locate and align print media cartridge 20 properly within print media cartridge socket 15 as print media cartridge 20 is inserted and installed into print media cartridge socket 15.

Cartridge housing right side 24 further comprises a right alignment tongue 31. Right alignment tongue 31 is an elongated horizontal ridge or protrusion jutting perpendicularly outward from the outside surface of cartridge housing right side 24 as depicted. The longitudinal axis of the elongated horizontal ridge or protrusion runs parallel with the longitudinal axis of cartridge housing right side 24. Right alignment tongue 31 is has a length, a width, a height, a distal end, and a proximal end. The length, width, and height of right alignment tongue 31 are sized to make a slip fit with the length, width, and depth respectively of right alignment groove 18 on print media cartridge socket 15. The distal end of right alignment tongue 31 is located toward the rear side 22 of the print media cartridge 20. The proximal end of right alignment tongue 31 is located toward the front side 21 of the print media cartridge 20.

The distal end of right alignment tongue 31 comprises a plurality of right alignment tongue locking teeth 32. Each right alignment tongue locking tooth 32 is a pyramid-shaped or triangular-shaped void that has been carved, machined, molded, cast, or otherwise removed from right alignment tongue 31. Right alignment tongue locking teeth 32 are sized and shaped to make a slip fit with right alignment groove locking teeth 19 on print media cartridge socket 15. Any particular shaped void positioned or located at any angle may be used. Right alignment tongue locking teeth 32 function to locate print media cartridge 20 properly within free axis or free rolling printer 5 during installation within free axis or free-rolling printer 5. Right alignment tongue locking teeth 32 are the first portions of print media cartridge 20 to enter right alignment groove 18 during insertion or installation of print media cartridge 20 into print media cartridge socket 15. Right alignment tongue locking teeth 32 also function to lock onto right alignment groove locking teeth 19 on print media cartridge socket 15 when the print media cartridge 20 is fully inserted and installed within free axis or free-rolling printer 5. As stated, it is very important for the all print media cartridges 20 installed within free axis or free rolling printer 5 to remain motionless and free from vibration with respect to the rest of the free axis or free rolling printer 5.

There is a void area 39 around three sides of right alignment tongue 31. There is a void area 39 above right alignment tongue 31, below right alignment tongue 31, and around the proximal end of right alignment tongue 31 as depicted. These void areas 39 allow right alignment tongue 31 to slightly pivot around the distal end of right alignment tongue 31, which is the only end or part of right alignment tongue 31 that is attached to cartridge housing right side 24. In this way the entire right alignment tongue 31 becomes a hinge so to speak that can be pivoted inward, pressed inward, or flexed inward when pressed. When released, left alignment tongue 28 springs back outward or returns to its original position.

The window or void area on cartridge housing front side 21 also allows access to a right pinch tab 34 as depicted. Right pinch tab 34 is a rigid loop, ring, cup, or depression that functions to provide an easy gripping point or grab point for a human finger or thumb. Right pinch tab 34 is rigidly connected to the proximal end of right alignment tongue 31. Right pinch tab 34 is accessible to the operator through the window or void area in cartridge housing front side 21. Right pinch tab 34 functions to allow the user to place their finger or thumb therein and squeeze or pull right alignment tongue 31 inward to cause the entire right alignment tongue 31 to pivot inward about its distal end which unlocks the print media cartridge 20 and allows for removal and/or insertion of print media cartridge 20. The user releases their thumb or finger from right pinch tab 34 to cause the entire right alignment tongue 31 to spring back or pivot back about its distal end to return to its original position in order to lock the print media cartridge 20. Left and right pinch tabs 33,34 are usually operated together where both are pinched or both released at the same time.

Free axis or free-rolling printer 5 further comprises: an X-axis tread system 40 and a Y-axis tread system 60. X-axis tread system 40 moves or mobilizes free axis or free-rolling printer 5 along an x-axis. The x-axis lies in the plane of the printing surface 100 and runs laterally along the printing surface 100. The x-axis runs from left to right or right to left on the printing surface 100 just as the words of a sentence on a printout run from left to right. Y-axis tread system 60 moves or mobilizes free axis or free-rolling printer 5 along a y-axis. The y-axis also lies in the plane of the printing surface 100 but is perpendicular to the x-axis. The y-axis runs up and down or top to bottom on the printing surface 100.

Figure 16:
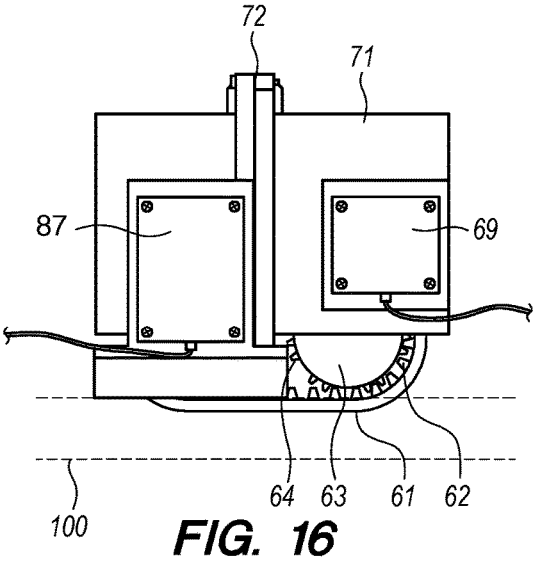
FIG. 16 a cross-sectional view taken from lines 16-16 with Y-axis tread system raised or retracted.
Figure 17:
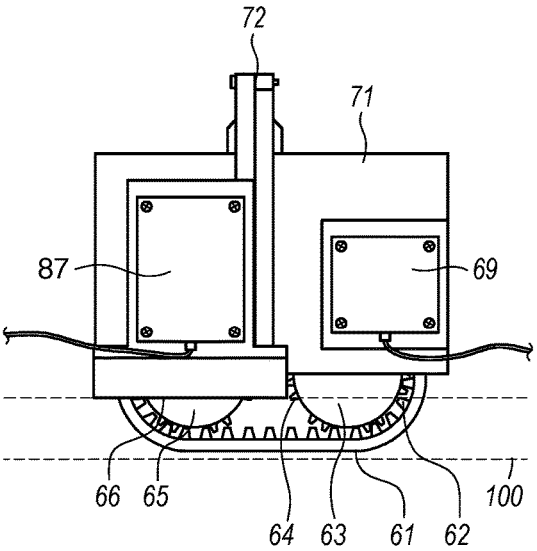
FIG. 17 a cross-sectional view taken from lines 16-16 with Y-axis tread system lowered or extended.
Figure 18:
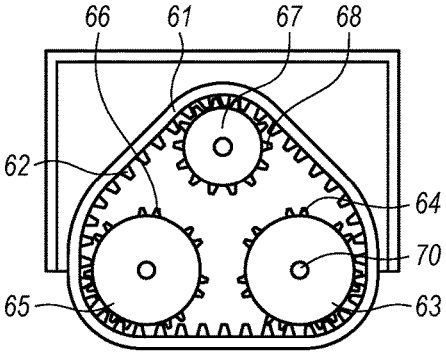
FIG. 18 is a cross-sectional view taken from lines 18-18.
Figure 19:
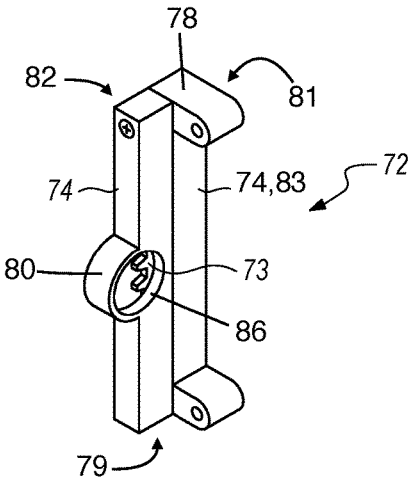
FIG. 19 is perspective view of gantry assembly.
Figure 20:
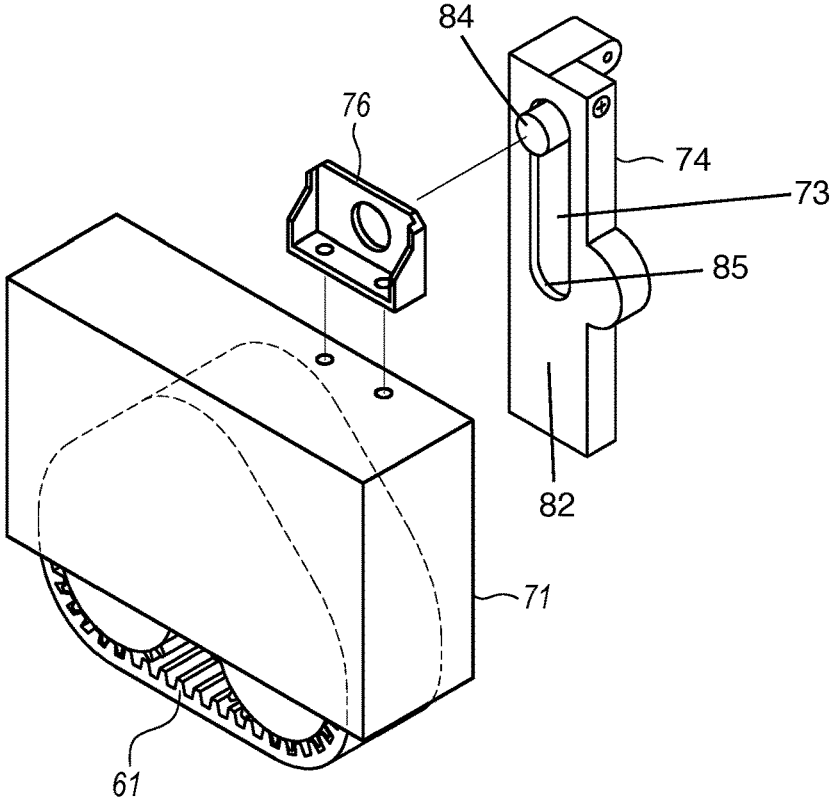
FIG. 20 is an exploded view of Y-axis tread assembly, gantry, and gantry bracket.
Figure 21:
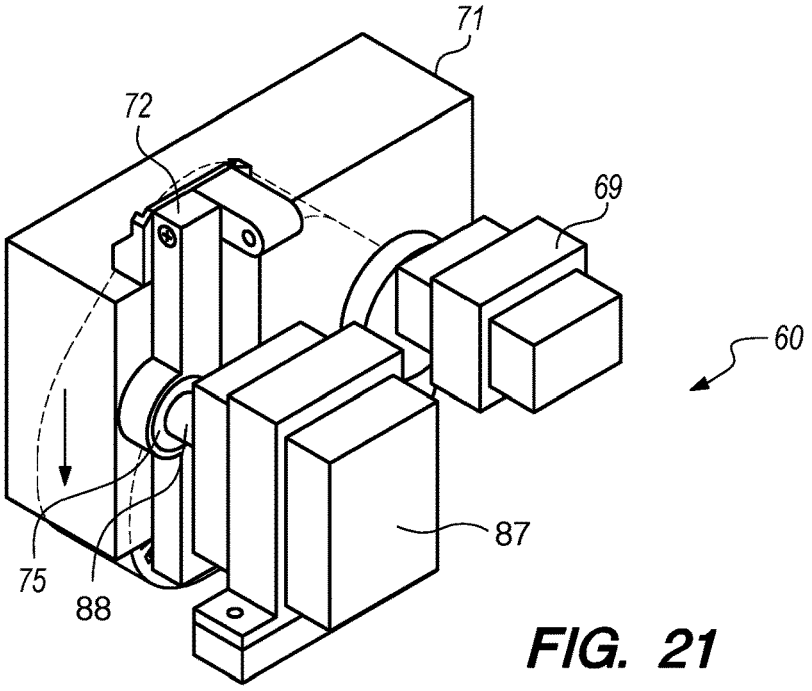
FIG. 21 is a perspective view of Y-axis tread system.
Figure 22:
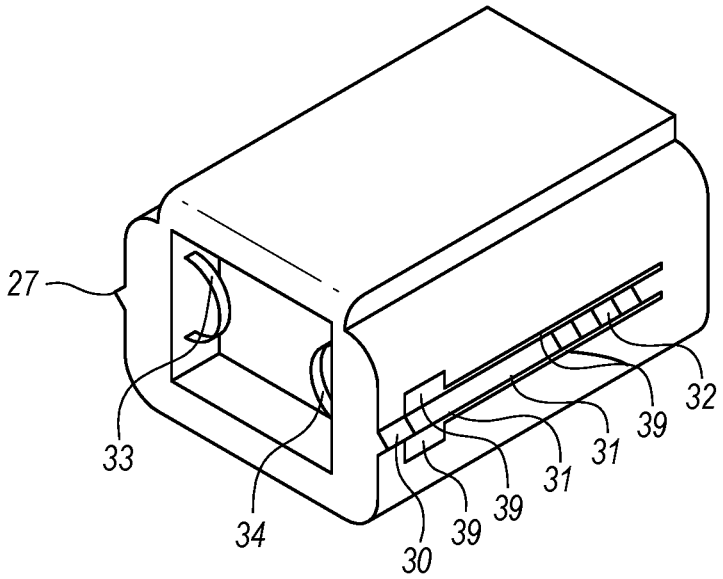
FIG. 22 is a perspective view of print media cartridge.

Y-axis tread system 60 is retractable. X-axis tread system 40 and y-axis tread system 60 work together or in tandem to properly move free axis or free-rolling printer 5 across the printing surface 100 in order to successfully complete a printing application. X-axis tread system 40 moves free axis or free-rolling printer 5 across the printing surface 100 from left to right and from right to left in repeated fashion. Each time free axis or free-rolling printer 5 moves from left to right or from right to left it prints a line or a portion of a line on the printing surface 100. After the line or line portion is completed and printed across the full width of the print surface 100, the Y-axis tread system 60 extends downward to contact the printing surface 100 and to lift X-axis tread system 40 out from contact with the printing surface 100 as depicted in FIG. 17. Then, Y-axis tread system 60 moves free axis or free-rolling printer 5 some distance along the y-axis in order to properly position or locate free axis or free-rolling printer 5 itself onto the proper starting point on the printing surface 100 in order for the next line of printing to begin. After free axis or free-rolling printer 5 is properly positioned along the y-axis for the next line of printing to begin, Y-axis tread system 60 retracts in order to restore contact of the X-axis tread system 40 with the printing surface 100 as depicted in FIG. 16. Upon which time, X-axis tread system 40 starts to move free axis or free-rolling printer 5 across the width of the printing surface 100 again in order to print the next line or portion of a line on the printing surface 100. This process is repeated until the print out is complete.

X-axis tread system 40 comprises: a X-axis continuous track or tread 41, a X-axis drive gear 43, a first X-axis foot gear 45, a second X-axis foot gear 47, a third X-axis foot gear 48, a fourth X-axis foot gear 49, a first X-axis roller 50, a second X-axis roller 51, and plurality of X-axis upper alignment gears 52. X-axis continuous track or tread 41 is a closed loop of resilient, flexible, or elastomeric material with a width, a circumference, an inner surface, and an outer surface. Any known type of resilient, flexible, or elastomeric material may be used such as: rubber, EPDM, EPM, ECO, ACM, ABR, Viton or FKM, Silicone, Buna-N, or other known flexible material. The width of X-axis continuous track or tread 41 is about 0.25-5 inches. The circumference of X-axis continuous track or tread 41 is about 10-50 inches. The outer surface of X-axis continuous track or tread 41 is smooth or flat. The outer surface of X-axis continuous track or tread 41 touches or makes contact with the print surface as free axis or free-rolling printer 5 is printing on the printing surface 100. The inner surface of X-axis continuous track or tread 41 has a plurality of ridges 42 that protrude perpendicularly inward from the inner surface of X-axis continuous track or tread 41. X-axis track ridges 42 are oblong protrusions that run longitudinally perpendicular to the circumference of X-axis continuous track or tread 41. X-axis track ridges 42 function to provide grip or traction for gears 43,45,47,48,49,52 by inter weaving with or meshing with teeth or ridges 44 on gears 43,45,47,48,49,52. In best mode, X-axis track ridges 42 are molded directly into X-axis continuous track or tread 41 and thus form an integral part of X-axis continuous track or tread 41. X-axis continuous track or tread 41 is wrapped around or wound around gears 43,45,47,48,49,52 to form an upside down or inverted U-shape as depicted. This inverted U-shape of X-axis continuous track or tread 41 is required to allow room or clearance space for the print media cartridge socket 15 and the print media cartridge 20 located in the center of the inverted U-shape.

X-axis drive gear 43 is located at the top of the inverted U-shape as depicted. X-axis drive gear 43 is a gear or cogwheel with teeth or ridges 44 protruding outward from the entire circumference of a rigid disk member. X-axis drive gear 43 may be any know type of gear. X-axis drive gear teeth or ridges 44 are sized and shaped to make a slip fit into the spaces between ridges 42 on X-axis continuous track or tread 41. X-axis drive gear teeth or ridges 44 intermesh with X-axis track ridges 42 on X-axis continuous track or tread 41 on the top and bottom of X-axis drive gear 43 as depicted. X-axis drive gear 43 functions to drive X-axis continuous track or tread 41 or rotate continuous track or tread 41 by transferring rotation motion from gear 43 to continuous track or tread 41 thereby causing rotation of continuous track or tread 41 to cause translational motion of free axis or free-rolling printer 5. X-axis drive gear 43 is rigidly attached to a main drive axle 95.

First and second X-axis foot gears 45,47 are located on the left side of the inverted U-shape as depicted. Third and fourth X-axis foot gears 48,49 are located on the right side of the inverted U-shape as depicted. First, second, third, and fourth X-axis foot gears 45,47,48,49 are each a gear or cogwheel with teeth or ridges 46 protruding outward from the entire circumference of a rigid disk member. First, second, third, and fourth X-axis foot gears 45,47,48,49 may be any known type of gears. X-axis foot gear teeth or ridges 46 are sized and shaped to make a slip fit into the spaces between X-axis track ridges 42 on X-axis continuous track or tread 41. Every third X-axis foot gear tooth or ridge 46 is missing as depicted to allow for proper alignment between X-axis foot gear teeth or ridges 46 and the spaces between ridges 42 on X-axis continuous track or tread 41 as X-axis continuous track or tread 41 makes the ninety degree bend around each foot gear to form the inverted U-shape.

First X-axis roller 50 is a roller or rigid cylindrical member. First X-axis roller 50 is located just above second X-axis foot gear 47 as depicted. First X-axis roller 50 helps form the inverted U-shape. First X-axis roller 50 presses against and supports the outer surface of X-axis continuous track or tread 41 to create a ninety degree bend in X-axis continuous track or tread 41 to create the left leg of the inverted U-shape. Second X-axis roller 51 is a roller or rigid cylindrical member. Second X-axis roller 51 is located just above third foot gear 48 as depicted. Second X-axis roller 51 helps form the inverted U-shape. Second X-axis roller 51 presses against and supports the outer surface of X-axis continuous track or tread 41 to create a ninety degree bend in X-axis continuous track or tread 41 to create the right leg of the inverted U-shape.

There are a plurality of X-axis upper alignment gears 52 located above X-axis foot gears 45,47,48,49 and above rollers 50,51 as depicted. Each X-axis upper alignment gear 52 is a gear or cogwheel with teeth or ridges protruding outward from the entire circumference of a rigid disk member. X-axis upper alignment gear teeth or ridges 53 are sized and shaped to make a slip fit into the spaces between X-axis track ridges 42 on X-axis continuous track or tread 41. X-axis upper alignment gears 52 function to retain tension in X-axis continuous track or tread 41 by pushing X-axis continuous track or tread 41 outward and keeping the inverted U-shape from collapsing as the X-axis continuous track or tread 41 is rotating. In best mode, there are six X-axis upper alignment gears 52, as depicted, however, there could be as few as two X-axis upper alignment gears 52 utilized to retain the inverted U-shape of X-axis continuous track or tread 41.

X-axis tread system 40 further comprises: an outside panel 54, inside panel 55, and a plurality of spacers 56. Outside panel 54 and inside panel 55 are each rigid planar members and are positioned parallel to each other with their edges aligned. Outside panel 54 and inside panel 55 are rigidly attached to each other by a plurality of spacers 56. All components of X-axis tread system listed above are sandwiched between outside panel 54 and inside panel 55 as depicted. X-axis drive gear 43, first X-axis foot gear 45, second axis foot gear 47, third axis foot gear 48, fourth axis foot gear 49, first x-axis roller 50, second X-axis roller 51, and all X-axis upper alignment gears 52 each have individual axles which they are pivotally attached thereto. Each of these individual axles is rigidly attached to the outside panel 54 and the inside panel 55 and positioned perpendicular to each. The assembly of outside panel 54, inside panel 55, and all spacers 56 functions to provide a support structure for X-axis tread system 40 and to hold all components of X-axis tread system 40 together.

Free axis or free-rolling printer 5 further comprises: an X-axis servomotor 57 and an X-axis drive axle 58. X-axis servomotor 57 is a servomotor that generates rotational motion in a precise and measured capacity. X-axis servomotor 57 may be any known type of servomotor. In best mode X-axis servomotor 57 is an electric motor. X-axis servomotor 57 has electrical continuity with a power source and a main circuit board or motherboard 90. X-axis servomotor 57 can rotate clockwise and counterclockwise. X-axis servomotor 57 is rigidly connected to X-axis drive axle 58. X-axis drive axle 58 is an axle. Any known type of axle may be used. X-axis drive axle 58 is positioned with its longitudinal axis running perpendicular to the loop of X-axis continuous track or tread 41. X-axis drive axle 58 is also rigidly connected to X-axis drive gear 43. When X-axis servomotor 57 rotates, this rotates X-axis drive gear 43, which rotates the loop of X-axis continuous track or tread 41.

In best mode, free axis or free-rolling printer 5 comprises two X-axis tread systems 40 as depicted with one X-axis tread system 40 on the front of a free axis or free-rolling printer 5 and a second X-axis tread system 40 on the rear of free axis or free-rolling printer 5. In this configuration, there is still only one X-axis drive axle 58 that is rigidly attached to a first X-axis drive gear 43 on one end and another first X-axis drive gear 43 on the other end as depicted. In this configuration, there are four X-axis tread clearance windows or void areas.

Y-axis tread system 60 comprises: a Y-axis continuous track or tread 61, a Y-axis drive gear 63, a Y-axis foot gear 65, and a Y-axis top gear 67. Y-axis continuous track or tread 61 is a resilient, flexible, or elastomeric closed loop of material with a width, a circumference, an inner surface, and an outer surface. Y-axis continuous track or tread 61 is a closed loop of resilient, flexible, or elastomeric material with a width, a circumference, an inner surface, and an outer surface. Any known type of resilient, flexible, or elastomeric material may be used such as: rubber, EPDM, EPM, ECO, ACM, ABR, Viton or FKM, Silicone, Buna-N, or other known flexible material. The width of Y-axis continuous track or tread 61 is about 0.25-5 inches. The circumference of Y-axis continuous track or tread 61 is about 5-30 inches. The outer surface of Y-axis continuous track or tread 61 is smooth or flat. The outer surface of Y-axis continuous track or tread 61 touches or makes contact with the print surface as free axis or free-rolling printer 5 is printing on the printing surface 100. The inner surface of Y-axis continuous track or tread 61 has a plurality of ridges 62 that protrude perpendicularly inward from the inner surface of Y-axis continuous track or tread 61. Y-axis track ridges 62 are oblong protrusions that run longitudinally perpendicular to the circumference of Y-axis continuous track or tread 61. Y-axis track ridges 62 function to provide grip or traction for gears 63,65,67 by inter weaving or meshing with teeth on these gears as depicted. In best mode, Y-axis track ridges 62 are molded directly into Y-axis continuous track or tread 61 and thus form an integral part of Y-axis continuous track or tread 61. Y-axis continuous track or tread 61 is wrapped around r wound around gears 63,65,67 to form a general triangular shape as depicted.

Y-axis drive gear 63 is located at the bottom rear of the triangular shape as depicted. Y-axis drive gear 63 is a gear or cogwheel with teeth or ridges 64 protruding outward from the entire circumference of a rigid disk member. Y-axis drive gear 63 may be any know type of gear. Y-axis drive gear teeth or ridges 64 are sized and shaped to make a slip fit into the spaces between ridges 62 on Y-axis continuous track or tread 61. Y-axis drive gear teeth or ridges 64 intermesh with Y-axis track ridges 62 on Y-axis continuous track or tread 61 on the bottom side and rear side of Y-axis drive gear 63 as depicted. Every third Y-axis drive gear tooth or ridge 64 is missing as depicted to allow for proper alignment between Y-axis drive gear teeth or ridges 64 and the spaces between ridges 62 on Y-axis continuous track or tread 61 as Y-axis continuous track or tread 61 makes the greater than ninety degree bend around drive gear 63 to form the triangular shaped loop. Y-axis drive gear 63 functions to drive Y-axis continuous track or tread 61 or rotate continuous track or tread 61 by transferring rotation motion from gear 63 to continuous track or tread 61 thereby causing rotation of continuous track or tread 61 to cause translational motion of free axis or free-rolling printer 5. Y-axis drive gear 63 is rigidly attached to a Y-axis drive axle 70.

Y-axis foot gear 65 is located at the bottom front of the triangular shape as depicted. Y-axis foot gear 65 is a gear or cogwheel with teeth or ridges 66 protruding outward from the entire circumference of a rigid disk member. Y-axis foot gear 65 may be any known type of gear. Y-axis foot gear teeth or ridges 66 are sized and shaped to make a slip fit into the spaces between Y-axis track ridges 62 on Y-axis continuous track or tread 61. Y-axis foot gear teeth or ridges 66 intermesh with Y-axis track ridges 62 on Y-axis continuous track or tread 61 on the bottom side and front side of Y-axis drive gear 63 as depicted. Every third Y-axis foot gear tooth or ridge 66 is missing as depicted to allow for proper alignment between Y-axis foot gear teeth or ridges 66 and the spaces between ridges 62 on Y-axis continuous track or tread 61 as Y-axis continuous track or tread 61 makes the greater than ninety degree bend around foot gear 65 to form the triangular shaped loop.

Y-axis top gears 67 located above Y-axis drive gear 63 and Y-axis foot gear 65 as depicted. Y-axis top gear 67 is a gear or cogwheel with teeth or ridges protruding outward from the entire circumference of a rigid disk member. Y-axis top gear teeth or ridges 68 are sized and shaped to make a slip fit into the spaces between Y-axis track ridges 62 on Y-axis continuous track or tread 61. Y-axis top gear 67 functions to retain tension in Y-axis continuous track or tread 61 by pushing Y-axis continuous track or tread 61 upwards and keeping the triangular shape from collapsing as the Y-axis continuous track or tread 61 is rotating.

Y-axis tread system 60 further comprises: a Y-axis servomotor 69 and a Y-axis drive axle 70. Y-axis servomotor 69 is a servomotor that generates rotational motion in a precise and measured capacity. Y-axis servomotor 69 may be any known type of servomotor. In best mode Y-axis servomotor 69 is an electric motor. Y-axis servomotor 69 has electrical continuity with a power source and electrical continuity with a main circuit board or motherboard 90. Y-axis servomotor 69 can rotate clockwise and counterclockwise. Y-axis servomotor 69 is rigidly connected to Y-axis drive axle 70. Y-axis drive axle 70 is an axle. Any known type of axle may be used. Y-axis drive axle 70 is positioned with its longitudinal axis running perpendicular to the loop of Y-axis continuous track or tread 61. Y-axis drive axle 70 is also rigidly connected to Y-axis drive gear 63. When Y-axis servomotor 69 rotates, this rotates Y-axis drive gear 63, which rotates the loop of Y-axis continuous track or tread 61.

Y-axis tread system 60 further comprises a housing 71. Y-axis tread system housing 71 is a rigid cover, bonnet, or hood that houses the above listed components of Y-axis tread system 60. Y-axis drive gear 63, Y-axis foot gear 65, and Y-axis top gear 67 each have individual axles pivotally attached thereto. Each of these individual axles is rigidly attached to Y-axis tread system housing 71 as depicted. Y-axis drive axle 70 is pivotally attached to Y-axis tread system housing 71. Y-axis servomotor 69 is rigidly attached to Y-axis tread system housing 71. This assembly of items attached to Y-axis tread system housing 71 functions to provide a support structure for the Y-axis tread system 60 and to hold all components of Y-axis tread system 60 together as this assembly is extended downwards from and reversibly retracted upwards into the bottom of free axis or free-rolling printer 5. This assembly is defined as Y-axis tread system housing assembly.

Y-axis tread system 60 further comprises a gantry assembly 72 that functions to vertically lower the Y-axis tread system 60 down from the bottom of free axis or free-rolling printer 5 and to vertically raise the Y-axis tread system 60 up into the bottom of free axis or free-rolling printer 5. Gantry assembly 72 uses a rack and pinion to translate rotational motion from a servomotor into translational motion of a rack where the rack is attached to the Y-axis tread system 60 and the rack is used to raise and lower the entire Y-axis tread system 60.

Gantry assembly 72 comprises: a rack 73, a rack housing 74, a pinion or gear 75, a gantry bracket 76, and a rack pin 84. Rack 73 is a rack member that is an elongated rigid member with a row of teeth or grooves along the entire length of one side. Any know type of rack may be used. Rack 73 has an upper end, a lower end, and a longitudinal axis. Pinion or gear 75 is a pinion, gear, or cogwheel with teeth or ridges protruding outward from the entire circumference of a rigid disk member. Any known type of pinion, gear, or cogwheel may be used. Rack housing 74 is an oblong rigid hollow cover structure with an upper end, a lower end, and a longitudinal axis. Rack housing 74 covers or encapsulates rack 73. Rack housing 74 is rigidly attached to rack 73. Rack housing 74 has: a top side 78, a bottom side 79, a front side 80, a rear side 81, an inner side 82, and an outer side 83. Rack housing top side 78, rack housing bottom side 79, rack housing front side 80, rack housing rear side 81, rack housing inner side 82, and rack housing outer side 83 are rigidly connected to each other at their edges to form a rigid hollow cover structure. In best mode, rack housing 74 is a rectangular cuboid member or hollow box-shaped member. The edges and/or corners of the rectangular cuboid member or hollow box-shaped member may be rounded. Rack housing 74 is rigidly attached to bottom side 13 of printer housing 7.

The longitudinal axis of rack housing 74 is positioned vertically. Rack 73 is located within the hollow structure of rack housing 74 as depicted. Rack 73 is positioned vertically and parallel with the longitudinal axis of rack housing 74. The longitudinal axis of rack 73 is parallel with that of rack housing 74. Rack 73 is positioned entirely within rack housing 74. The outer side 83 of rack housing 74 further comprises a pinion or gear window 86. Pinion or gear window 86 is a void or window in outer side 83. Pinion or gear window 86 functions to allow for a mechanical connection or linkage between the pinion or gear 75 and the rack 73. The pinion or gear 75 is installed within teeth or grooves on rack 73 just as a pinion is normally installed within a rack. The teeth or ridges from pinion or gear 75 are interweaved within the teeth or grooves on rack 73 where pinion or gear 75 is inserted through the pinion or gear window 86 in order to make contact with the rack 73. The inner side 82 of rack housing 74 further comprises a rack pin slot 85 at its upper end. Rack pin slot 85 is an elongated void or elongated window running longitudinally along inner side 82. The longitudinal axis of rack pin slot 85 is parallel with the longitudinal axis of rack 73. The length of rack pin slot 85 is about 0.5-10 inches. Rack pin slot 85 may extend to the lower end of rack housing 74.

Rack pin 84 is a rigid oblong member. In best mode, rack pin 84 is a rigid solid cylindrical member. Rack pin 84 is positioned horizontally and perpendicular to the longitudinal axis of rack 73. Rack pin 84 has an inner end and an outer end. Rack pin is rigidly attached to the upper end of rack 73. The inner end of rack pin 84 is rigidly attached to the upper end of rack 73 or near the upper end of rack 73. The outer end of rack pin 84 protrudes through rack pin slot 85 as depicted. The outer end of rack pin 84 is rigidly attached to gantry bracket 76. Gantry bracket 76 is a rigid bracket member. Gantry bracket 76 is rigidly attached to rack housing 74. Rack housing 74 and gantry bracket 76 function to rigidly attach rack 73, through rack pin 84, to Y-axis tread system housing 71. These rigid attachments thereby rigidly linking the entire Y-axis tread system housing assembly to the upper end of rack 73. With this linkage, the entire Y-axis tread system housing assembly is raised and lowered as rack 73 is raised and lowered.

Y-axis tread system 60 further comprises: a gantry servomotor 87 and a gantry servomotor axle 88. Gantry servomotor 87 is a servomotor that generates rotational motion in a precise and measured capacity. Gantry servomotor 87 may be any known type of servomotor. In best mode gantry servomotor 87 is an electric motor. Gantry servomotor 87 has electrical continuity with a power source and electrical continuity with a main circuit board or motherboard 90. Gantry servomotor 87 can rotate clockwise and counterclockwise. Gantry servomotor 87 is rigidly connected to gantry servomotor axle 88. Gantry servomotor axle 88 is an axle with a longitudinal axis. Any known type of axle may be used. Gantry servomotor axle 88 is positioned with its longitudinal axis running perpendicular to the loop of Y-axis continuous track or tread 61. Gantry servomotor axle 88 is also rigidly connected to gantry pinion or gear 75.

During extension and retraction of the Y-axis tread system 60, the gantry servomotor 87 rotates the gantry pinion or gear 75 clockwise or counterclockwise. When the gantry pinion or gear 75 rotates in one direction, this forces rack 73 and rack pin 84 downward, thereby lowering the whole Y-axis tread system housing assembly downward with respect to housing 7 in order to cause Y-axis continuous track or tread 61 to contact printing surface 100 as depicted in FIG. 17. When the gantry pinion or gear 75 rotates in the other direction, this forces the rack 73 and rack pin 84 upward in order to lift the whole Y-axis tread system housing assembly upward with respect to printer housing 7 to remove Y-axis continuous track or tread 61 from contact with printing surface 100 as depicted in FIG. 16. The gantry servomotor 77 drives the retraction and extension mechanism of the Y-axis tread system 60.

In best mode, free axis or free-rolling printer 5 comprises two Y-axis tread systems 60 as depicted with one Y-axis tread system 60 on the left side of a free axis or free-rolling printer 5 and a second Y-axis tread system 60 on the right side of free axis or free-rolling printer 5, each with its own Y-axis tread clearance window or void area.

Free axis or free-rolling printer 5 further comprises: a main circuit board or motherboard 90 and a servomotor control circuit board 92. Main circuit board or motherboard 90 and servomotor control circuit board 92 are each circuit boards with a plurality of electrical circuits. Main circuit board or motherboard 90 has electrical continuity with servomotor control circuit board 92. Main circuit board or motherboard 90 and servomotor control circuit board 92 each have electrical continuity with a power source. Servomotor control circuit board 92 has electrical continuity with: X-axis drive servomotor 57, each Y-axis servomotor 69, and each gantry servomotor 77. Electrical wiring 96 is used for these electrical connections. Free axis or free-rolling printer 5 further comprises an on/off switch 94 that has electrical continuity with main circuit board or motherboard 90 and servomotor control circuit board 92. Free axis or free-rolling printer 5 further comprises a power connector 98 that has electrical continuity with main circuit board or motherboard 90 and servomotor control circuit board 92. Power connector 98 has electrical continuity with either a wireless battery or an alternating current wired power source.

What is claimed is:

1. A free axis or free-rolling printer comprising:

an X-axis continuous track or tread; an X-axis drive gear; a first X-axis foot gear; a second X-axis foot gear; a third X-axis foot gear; a fourth X-axis foot gear; an X-axis servomotor; and an X-axis drive axle;

a Y-axis continuous track or tread; a Y-axis drive gear; a Y-axis drive axle; a Y-axis foot gear; a Y-axis top gear; a housing; a rack; a pinion gear; a Y-axis servomotor; a gantry servomotor; a gantry servomotor axle; and a print media cartridge socket, wherein, said free axis or free-rolling printer is a printer that ejects ink or colorant onto a stationary flat horizontal plane or surface, said free axis or free-rolling printer is self-propelled or capable of self-propelled movement along said stationary flat horizontal plane or surface, said free axis or free-rolling printer comprises: a front side, a rear side, a left side, a right side, a top side, and bottom side;

wherein said X-axis continuous track or tread is a closed loop of resilient, flexible, or elastomeric material with an outer surface and an inner surface, said outer surface of said X-axis continuous track or tread continuously contacts said stationary flat horizontal plane or surface during operation of said free axis or free-rolling printer, and said inner surface of said X-axis continuous track or tread has a plurality of ridges that protrude inward therefrom;

wherein said X-axis drive gear is a gear or cogwheel with a plurality teeth or ridges protruding radially outward therefrom, said X-axis drive axle is an axle, said X-axis drive gear is rigidly attached to said X-axis drive axle, said first, second, third, and fourth X-axis foot gears are each a gear or cogwheel with a plurality teeth or ridges protruding radially outward therefrom, said X-axis drive gear, said first X-axis foot gear, said second X-axis foot gear, said third X-axis foot gear, and said fourth X-axis foot gear are each pivotally attached to said free axis or free-rolling printer, said X-axis continuous track or tread is wrapped around or wound around said X-axis drive gear, said first X-axis foot gear, said second X-axis foot gear, said third X-axis foot gear, and said fourth X-axis foot gear, so that the plurality of ridges of said X-axis continuous track or tread inter weave or mesh with the plurality teeth or ridges on each of said X-axis drive gear, said first X-axis foot gear, said second X-axis foot gear, said third X-axis foot gear, and said fourth X-axis foot gear, wherein said X-axis servomotor is a servomotor, and said X-axis servomotor is rigidly attached to said X-axis drive axle;

wherein said Y-axis continuous track or tread is a closed loop of resilient, flexible, or elastomeric material with an outer surface and an inner surface, said outer surface of said Y-axis continuous track or tread periodically or intermittingly contacts said stationary flat horizontal plane or surface during operation of said free axis free-rolling printer, and said inner surface of said Y-axis continuous track or tread has a plurality of ridges that protrude inward therefrom, wherein said Y-axis drive gear is a gear or cogwheel with a plurality of teeth or ridges protruding radially outward therefrom, said Y-axis drive axle is an axle, said Y-axis drive gear is rigidly attached to said Y-axis drive axle, said Y-axis foot gear is a gear or cogwheel with a plurality teeth or ridges protruding radially outward therefrom, and said Y-axis top gear is a gear or cogwheel with a plurality teeth or ridges protruding radially outward therefrom, wherein said housing is a rigid member, and said Y-axis drive gear, said Y-axis foot gear, and said Y-axis top gear are each pivotally attached to said housing, said Y-axis continuous track or tread is wrapped around or wound around said Y-axis drive gear, said Y-axis foot gear, and said Y-axis top gear, so that said plurality of ridges of said Y-axis continuous track or tread inter weave or mesh with said plurality of teeth or ridges on each of said Y-axis drive gear, said Y-axis foot gear, and said Y-axis top gear, said rack is a rack or an elongated rigid member with a row of teeth or grooves along one side, said rack is rigidly connected to said housing, said pinion gear is a pinion, gear, or cogwheel with a plurality of teeth or ridges protruding radially outward therefrom, said pinion gear is positioned so that said plurality of teeth or ridges of said pinion gear interweave or mesh with said teeth or grooves of said rack, said gantry servomotor axle is an axle, and said pinion gear is rigidly attached to said gantry servomotor axle, said gantry servomotor is a servomotor, and said gantry servomotor is rigidly attached to said gantry servomotor axle, said Y-axis servomotor is a servomotor, and said Y-axis servomotor is rigidly attached to said Y-axis drive axle;

wherein the print media cartridge socket, is a slot or void in said bottom side of said free axis or free-rolling printer, said print media cartridge socket comprises: a left wall, a right wall, a rear wall, and a top wall, which are each a rigid rectangular planar member with a longitudinal axis, a lateral axis, an inside surface, and an outside surface, said left wall of said print media cartridge socket has a left alignment groove that is an elongated horizontal groove or recess in said outside surface of said left wall, running parallel with said longitudinal axis of said left wall, said left alignment groove has a proximal end and a distal end, said distal end of said left alignment groove comprises a plurality of left alignment groove locking teeth, wherein each of said plurality of left alignment groove locking teeth is a pyramid-shaped or triangular-shaped protrusion in said left alignment groove, said right wall of said print media cartridge socket has a right alignment groove that is an elongated horizontal groove or recess in said outside surface of said right wall, running parallel with said longitudinal axis of said right wall, said right alignment groove has a proximal end and a distal end, said distal end of said right alignment groove comprises a plurality of right alignment groove locking teeth, and wherein each of said plurality of right alignment groove locking teeth is a pyramid-shaped or triangular-shaped protrusion in said right 1 50 alignment groove.

* * * * *